US010897105B2

(12) United States Patent
Iizuka et al.

(10) Patent No.: US 10,897,105 B2
(45) Date of Patent: Jan. 19, 2021

(54) CONNECTOR WITH AN ANNULAR SHAPED MEGNETIC CORE

(71) Applicant: Yazaki Corporation, Tokyo (JP)

(72) Inventors: Hayato Iizuka, Shizuoka (JP); Kazuma Kayo, Shizuoka (JP); Hajime Kato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/824,636

(22) Filed: Mar. 19, 2020

(65) Prior Publication Data

US 2020/0313357 A1 Oct. 1, 2020

(30) Foreign Application Priority Data

Mar. 25, 2019 (JP) ..... 2019-056751

(51) Int. Cl.

| | |
|---|---|
| ***H01R 13/648*** | (2006.01) |
| ***H01R 13/424*** | (2006.01) |
| ***H01R 13/52*** | (2006.01) |
| ***H01R 13/533*** | (2006.01) |
| ***H01R 25/16*** | (2006.01) |

(52) U.S. Cl.

CPC ..... *H01R 13/648* (2013.01); *H01R 13/424* (2013.01); *H01R 13/5202* (2013.01); *H01R 13/533* (2013.01); *H01R 25/161* (2013.01); *H01R 2201/26* (2013.01)

(58) Field of Classification Search

CPC .... H01R 13/648; H01R 13/424; H01R 13/42; H01R 13/40; H01R 13/5202; H01R 13/52; H01R 13/46; H01R 13/533; H01R 13/53

USPC ..... 174/259; 439/38

See application file for complete search history.

(56) References Cited

U.S. PATENT DOCUMENTS 6,582,249 B1 * 6/2003 Boeck ..... H02S 40/34 439/492
6,669,506 B2 * 12/2003 Newton ..... B60T 13/665 439/559
7,097,516 B2 * 8/2006 Werner ..... H01R 13/629 439/709

(Continued)

FOREIGN PATENT DOCUMENTS

JP 2018-64428 A 4/2018
JP 2018-148072 A 9/2018

*Primary Examiner* — Harshad C Patel
(74) *Attorney, Agent, or Firm* — Kenealy Vaidya LLP

(57) ABSTRACT

A connector includes a plurality of conductors, a magnetic core, and a housing, the housing includes a housing member that is provided with a housing chamber that houses the plurality of conductors and the magnetic core, an abutment surface on which a core assembling portion abuts, and an opening that is arranged to face the abutment surface at an interval and exposes the core assembling portion housed in the housing chamber outward, the core assembling portion being composed of the respective intermediate portions of the plurality of conductors and the magnetic core housed in the housing chamber; a cover member that closes the opening; and a pressing member that is sandwiched between the cover member and the core assembling portion by pressing the core assembling portion to push the core assembling portion against the abutment surface when the housing member and the cover member are in an assembled state.

9 Claims, 11 Drawing Sheets

(56) References Cited

U.S. PATENT DOCUMENTS

| | | | | |
|---|---|---|---|---|
| 7,134,883 | B2 * | 11/2006 | Werner | H02S 40/34 439/76.1 |
| 7,282,635 | B2 * | 10/2007 | Utsunomiya | H02S 40/34 136/244 |
| 7,291,036 | B1 * | 11/2007 | Daily | H02S 40/34 439/487 |
| 7,484,970 | B1 * | 2/2009 | Chen | H04Q 1/142 439/76.1 |
| 7,914,298 | B2 * | 3/2011 | Lauermann | H02S 40/34 439/76.1 |
| 8,083,540 | B1 * | 12/2011 | Spicer | H02S 40/34 439/460 |
| 9,306,313 | B2 * | 4/2016 | Heggemann | H01R 13/5202 |
| 10,355,418 | B2 * | 7/2019 | Iizuka | H01F 17/062 |
| 10,707,628 | B2 * | 7/2020 | Iizuka | H01F 17/062 |
| 2013/0105218 | A1 * | 5/2013 | Kuboshima | B60R 16/0215 174/72 A |
| 2016/0255750 | A1 * | 9/2016 | Yoshida | H05K 9/0098 174/359 |
| 2017/0174152 | A1 * | 6/2017 | Yamaguchi | H01B 7/0045 |
| 2017/0263350 | A1 * | 9/2017 | Oka | B60R 16/0215 |
| 2018/0109040 | A1 | 4/2018 | Iizuka et al. | |
| 2018/0261930 | A1 * | 9/2018 | Iizuka | H01R 4/04 |
| 2018/0294605 | A1 * | 10/2018 | Iizuka | H01R 13/7193 |
| 2018/0374634 | A1 * | 12/2018 | Iizuka | H01F 27/24 |

* cited by examiner

CONNECTOR WITH AN ANNULAR SHAPED MEGNETIC CORE

CROSS-REFERENCE TO RELATED APPLICATION(S)

The present application claims priority to and incorporates by reference the entire contents of Japanese Patent Application No. 2019-056751 filed in Japan on Mar. 25, 2019.

BACKGROUND OF THE INVENTION

1. Field of the Invention

The present invention relates to a connector.

2. Description of the Related Art

Conventionally, a surge reduction device that reduces a surge current on an electric circuit by covering a conductor on the electric circuit with an annular magnetic core has been known (see Japanese Patent Application Laid-open No. 2018-064428). The surge reduction device is provided at any place on the electric circuit, and is arranged close to, for example, an electric device that is a surge voltage generation source. Therefore, conventionally, a connector electrically connected to the electric device may be configured to also have a function as a surge reduction device (see Japanese Patent Application Laid-open No. 2018-148072). For example, in a vehicle such as a hybrid vehicle or an electric vehicle, a surge voltage with a steep rise is generated in an inverter, and there is a possibility that a surge current accompanying the surge voltage will be input to a rotary machine through an electric circuit by a wire harness. Therefore, the connector electrically connected to the inverter is configured to also have function as the surge reduction device.

By the way, there is a possibility that an external input such as vibration will act on the connector, for example, while the vehicle is traveling. Therefore, in a case where the connector is configured to also have the function as the surge reduction device, it is necessary to protect a magnetic core from such an external input.

SUMMARY OF THE INVENTION

Therefore, an object of the present invention is to provide a connector in which a magnetic core can be protected.

In order to solve the above mentioned problem and achieve the object, a connector according to one aspect of the present invention includes a plurality of conductors that are electrically connected to counterparts; an annular shaped magnetic core that includes an insertion hole into which respective intermediate portions of the plurality of conductors are inserted; and a housing that houses the plurality of conductors and the magnetic core, wherein the housing includes: a housing member that is provided with a housing chamber that houses the plurality of conductors and the magnetic core, an abutment surface on which a core assembling portion abuts, and an opening that is arranged to face the abutment surface at an interval and exposes the core assembling portion housed in the housing chamber outward, the core assembling portion being composed of the respective intermediate portions of the plurality of conductors and the magnetic core housed in the housing chamber; a cover member that closes the opening; and a pressing member that is sandwiched between the cover member and the core assembling portion by pressing the core assembling portion to push the core assembling portion against the abutment surface when the housing member and the cover member are in an assembled state.

According to another aspect of the present invention, in the connector, it is preferable that the pressing member is integrated with the cover member.

According to still another aspect of the present invention, in the connector, it is preferable that the conductor includes: a first electrical connection portion that is electrically connected to a first counterpart conductor prepared for each conductor; a second electrical connection portion that is electrically connected to a second counterpart conductor prepared for each conductor; a bent portion that is bent between a side of the first electrical connection portion and a side of the second electrical connection portion; and an intermediate portion that is provided between the first electrical connection portion and the bent portion.

According to still another aspect of the present invention, in the connector, it is preferable that the conductor includes: a bus bar that includes the first electrical connection portion, the second electrical connection portion, the bent portion, and the intermediate portion; a first terminal fitting that is physically and electrically connected to the first electrical connection portion and is physically and electrically connected to the first counterpart conductor; and a second terminal fitting that is physically and electrically connected to the second electrical connection portion and is physically and electrically connected to the second counterpart conductor.

According to still another aspect of the present invention, in the connector, it is preferable that the connector includes a liquid-proof member that is arranged between the opening of the housing member and the cover member and fills a gap between the opening of the housing member and the cover member to suppress permeation of a liquid into the housing chamber.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
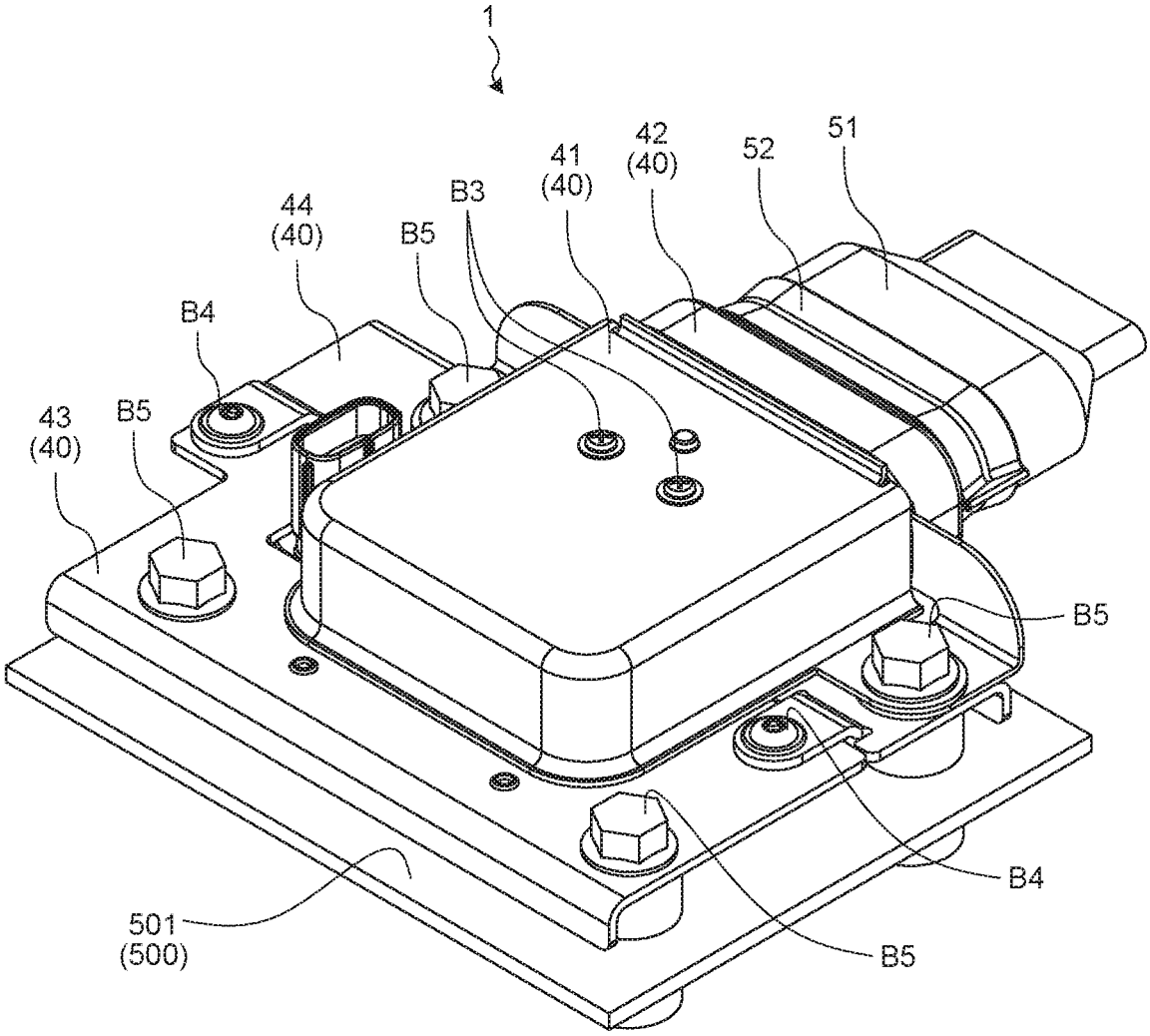
FIG. 1 is a perspective view illustrating a connector of an embodiment together with a counterpart electric device.
Figure 2:
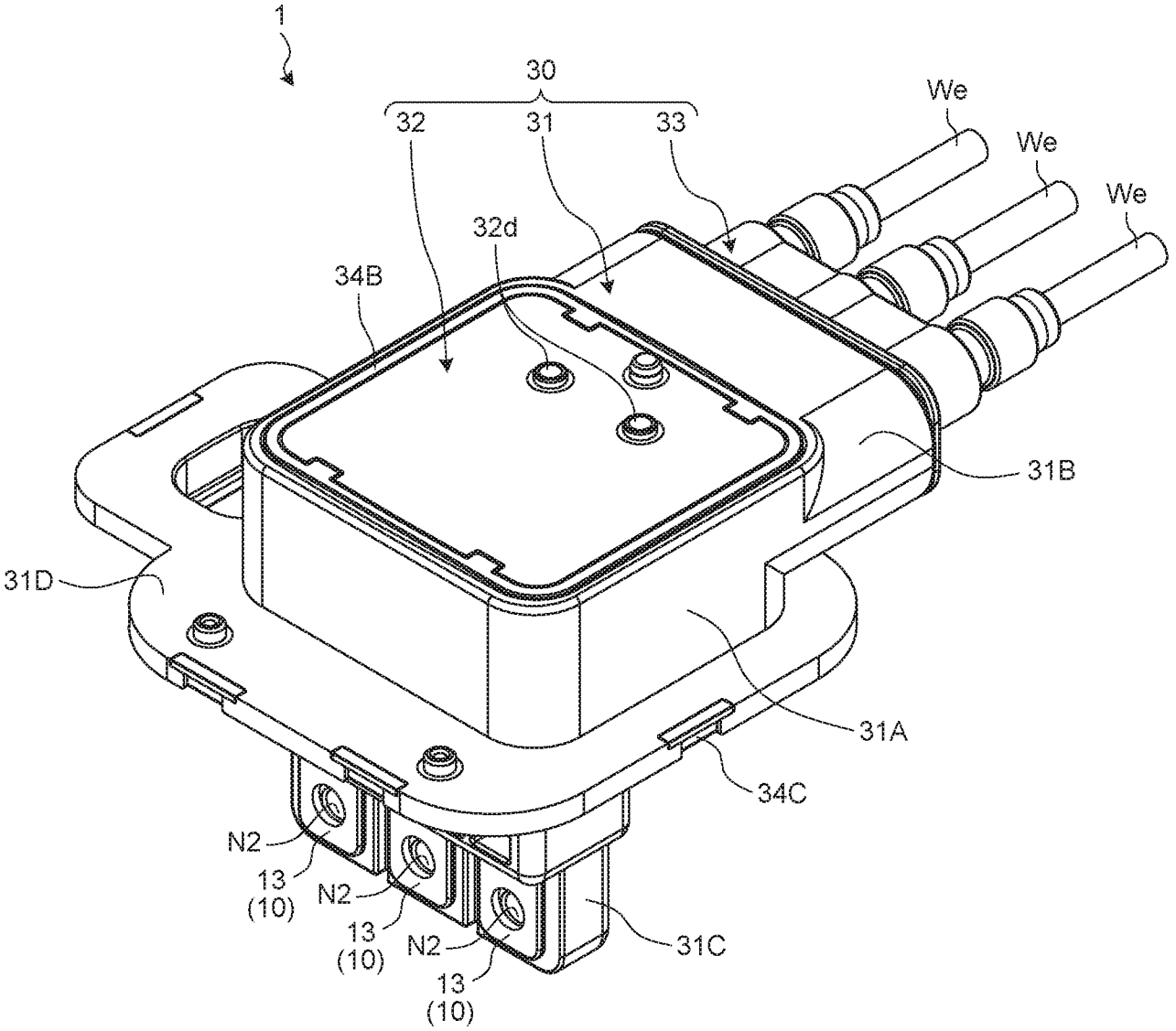
FIG. 2 is a perspective view illustrating the connector (excluding a shield shell) of the embodiment.
Figure 3:
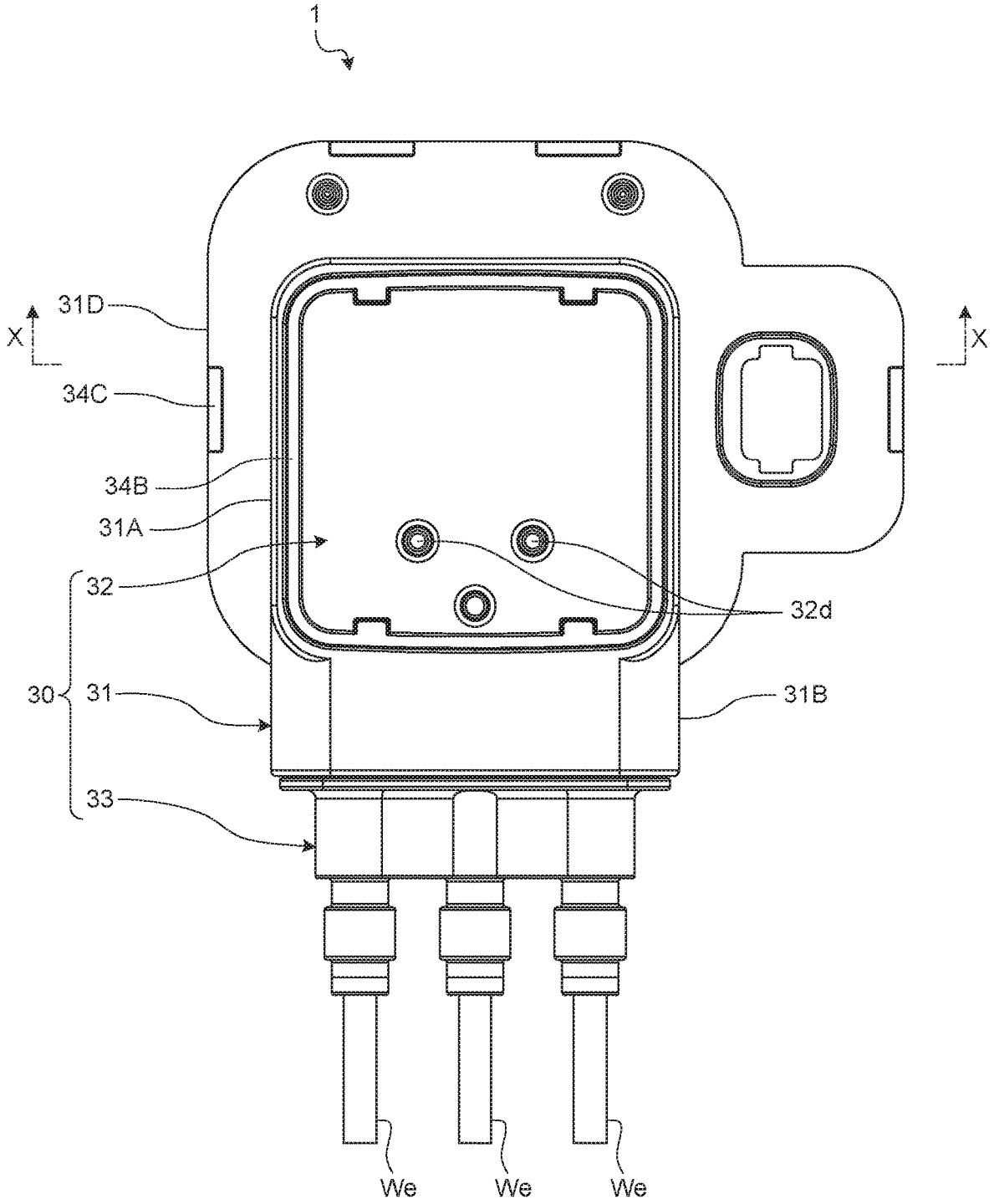
FIG. 3 is a plan view illustrating the connector (excluding the shield shell) of the embodiment.

Hereinafter, an embodiment of a connector according to the present invention will be described in detail with reference to the drawings. Note that the present invention is not limited by this embodiment.

Embodiment

One of embodiments of a connector according to the present invention will be described with reference to FIGS. 1 to 11.

Reference numeral 1 in FIGS. 1 to 5 indicates a connector of the present embodiment.

The connector 1 is attached to an electric device 500 of a counterpart, and is electrically connected to the electric device 500 (see FIG. 1). The connector 1 includes a plurality of conductors 10 that are electrically connected to counterparts and a magnetic core 20 that includes an insertion hole 20*a* into which the plurality of conductors 10 are to be inserted and has an annular shape (see FIGS. 4 and 5). For example, the connector 1 is provided in a wire harness together with three-phase electric wires We (see FIGS. 2, 3 and 5) connecting a rotary machine and an inverter as the electric device 500 to each other. Therefore, the connector 1 includes the conductors 10 (three conductors 10) by the number of electric wires We. In the connector 1, there is a possibility that a surge current accompanying a surge voltage generated in the inverter will flow through each conductor 10. Therefore, in the connector 1, in order to reduce the surge current flowing through the three conductors 10 to suppress an input of the surge current to the rotary machine, the three conductors 10 are inserted into the insertion hole 20*a* of the magnetic core 20.

The conductor 10 is electrically connected to each of a first counterpart conductor and a second counterpart conductor that are prepared for each conductor 10. The conductor 10 includes a first electrical connection portion 10*a* electrically connected to the electric wire We as the first counter conductor and a second electrical connection portion 10*b* electrically connected to the second counter conductor {a terminal fitting (not illustrated) of the electric device 500} (see FIGS. 6 and 7).

The conductor 10 may have a straight shape in which the first electrical connection portion 10*a* and the second electrical connection portion 10*b* are linearly arranged, and may have an intersection shape in which the first electrical connection portion 10*a* and the second electrical connection portion 10*b* intersect each other. The conductor 10 of this example is formed in the latter intersection shape, and includes a bent portion 10*c* bent between a side of the first electrical connection portion 10*a* and a side of the second electrical connection portion 10*b* (see FIGS. 6 and 7). Here, the bent portion 10*c* bent at 90 degrees is provided in order to form an L-shaped conductor 10 in which the first electrical connection portion 10*a* side and the second electrical connection portion 10*b* side are orthogonal to each other. Note that the conductor 10 having the straight shape includes the first electrical connection portion 10*a*, the second electrical connection portion 10*b*, and an intermediate portion 10*d* having a spiral shape described below, but does not include the bent portion 10*c*, to correspond to a conductor having a form as illustrated in the above JP 2018-148072 A.

Figure 4:
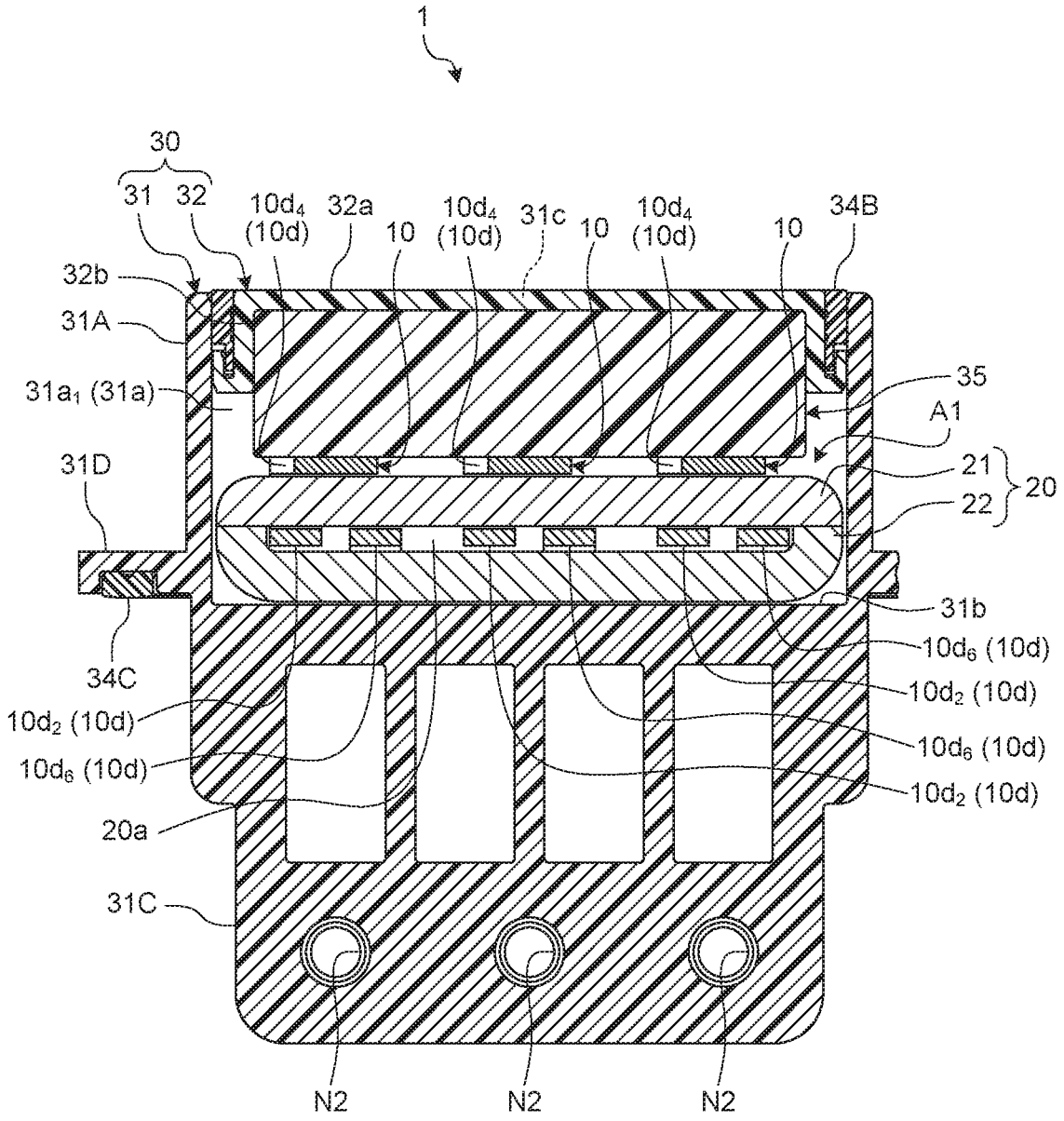
FIG. 4 is a sectional view taken along line X-X of FIG. 3.
Figure 6:
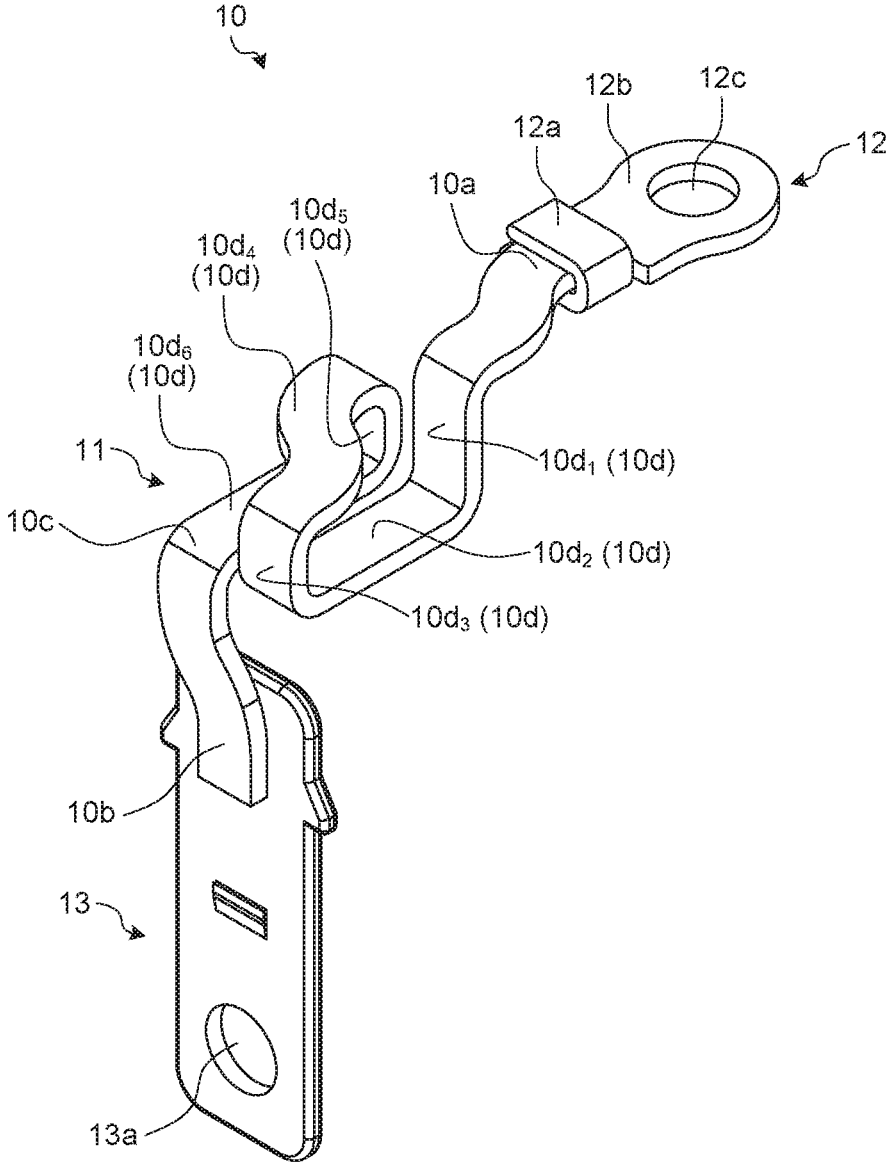
FIG. 6 is a perspective view illustrating a conductor.
Figure 7:
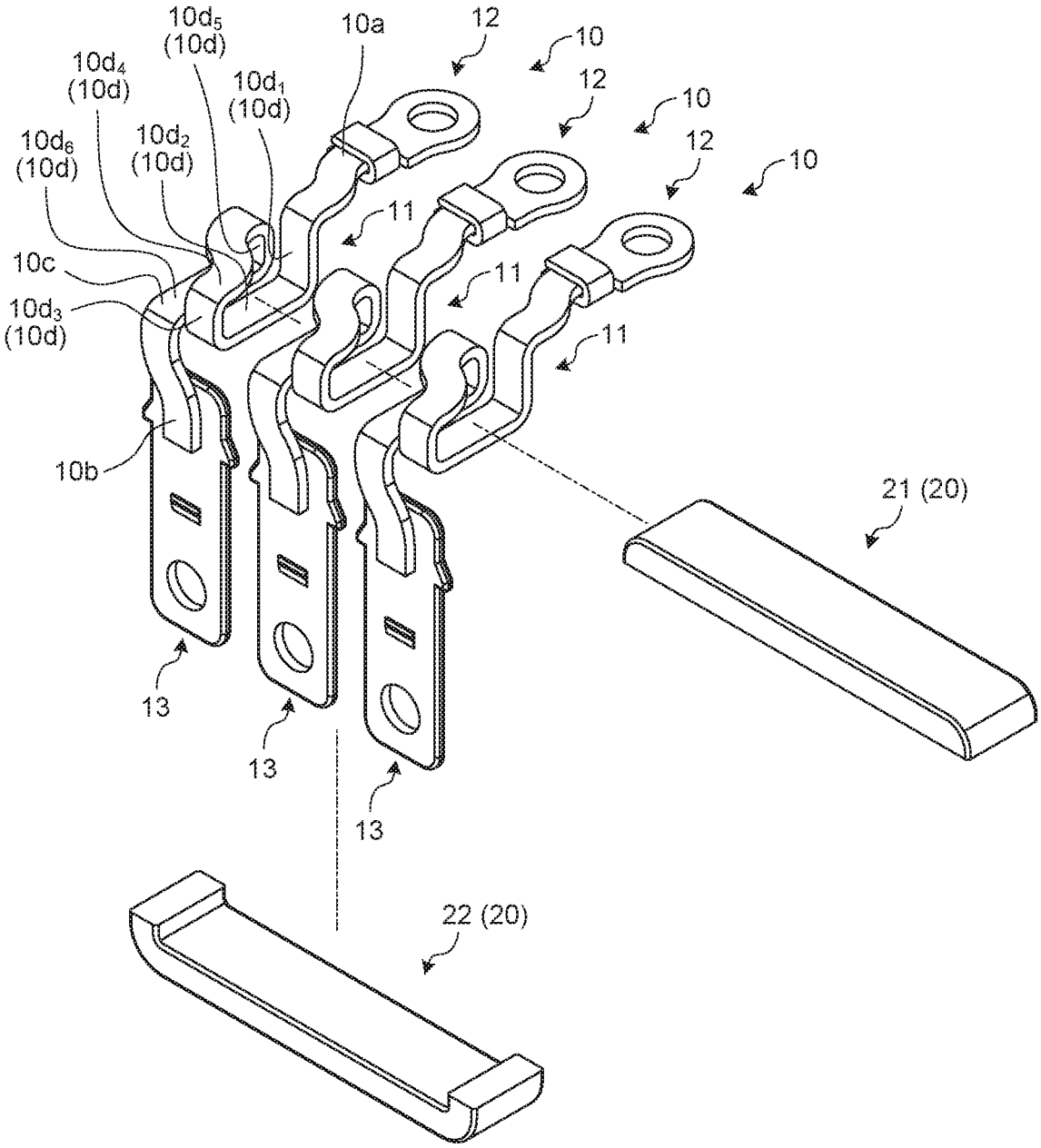
FIG. 7 is an exploded perspective view illustrating the conductor and a magnetic core.

The conductor 10 includes an intermediate portion 10*d* provided between the first electrical connection portion 10*a* and the bent portion 10*c* (see FIGS. 4, 6, and 7). In the conductor 10, the magnetic core 20 is assembled to the intermediate portion 10*d* in a state where the intermediate portion 10*d* is inserted into the insertion hole 20*a* of the magnetic core 20. In the conductor 10 of this example, the magnetic core 20 is assembled to the intermediate portion 10*d* by inserting the intermediate portion 10*d* into the insertion hole 20*a* of the magnetic core 20 and winding the intermediate portion 10*d* around the magnetic core 20. Therefore, the intermediate portion 10*d* is formed in a spiral shape between the first electrical connection portion 10*a* and the bent portion 10*c*. Here, the intermediate portion 10*d* is formed in a spiral shape having 1.5 screw threads. The spiral shape is formed in a shape along the magnetic core 20 as described later.

Figure 5:
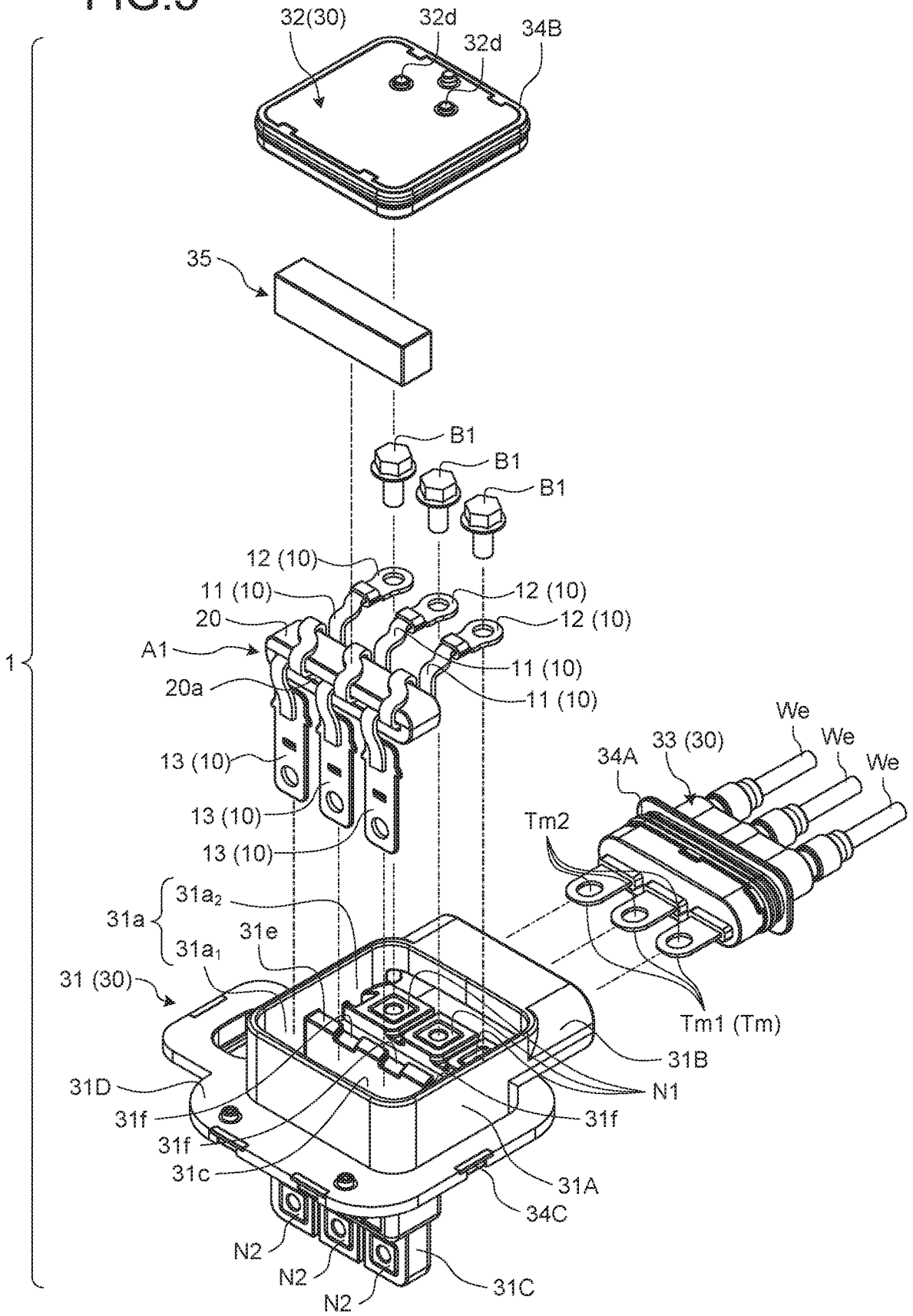
FIG. 5 is an exploded perspective view illustrating the connector (excluding the shield shell) of the embodiment.

Specifically, the conductor 10 of this example includes a bus bar 11 that includes the first electrical connection portion 10*a*, the second electrical connection portion 10*b*, the bent portion 10*c*, and the intermediate portion 10*d*, a first terminal fitting 12 that is physically and electrically connected to the first electrical connection portion 10*a* and is physically and electrically connected to the first counterpart conductor (the electric wire We), and a second terminal fitting 13 that is physically and electrically connected to the second electrical connection portion 10*b* and is physically and electrically connected to the second counterpart conductor (the terminal fitting of the electric device 500) (see FIGS. 5 to 7). Each of the bus bar 11, the first terminal fitting 12, and the second terminal fitting 13 is molded from a conductive material such as a metal. For example, each of the bus bar 11, the first terminal fitting 12, and the second terminal fitting 13 is molded in a predetermined shape by performing press-molding such as bending or cutting on a metal plate which is a base material.

The bus bar 11 is molded in a predetermined shape by performing press-molding such as bending or cutting on a metal plate which is a base material. In the bus bar 11, the first electrical connection portion 10*a* and the second electrical connection portion 10*b* are formed in a single body shape, and the first electrical connection portion 10*a* and the second electrical connection portion 10*b* are arranged to be orthogonal to each other by the bent portion 10*c*.

The first terminal fitting 12 includes a first electrical connection portion 12*a* physically and electrically connected to the first electrical connection portion 10*a* and a second electrical connection portion 12*b* physically and electrically connected to the first counterpart conductor (the electric wire We) (see FIG. 6).

The first terminal fitting 12 of this example is physically and electrically connected to the first electrical connection portion 10*a* by sandwiching the first electrical connection portion 10*a* of the bus bar 11 by the first electrical connection portion 12*a* bent in a U-shape. For example, the first electrical connection portion 12*a* may be caulked and crimped against the first electrical connection portion 10*a* or may be bonded to the first electrical connection portion 10*a* by welding or the like.

In addition, in the first terminal fitting 12 of this example, the second electrical connection portion 12*b* is formed in a single body shape, and the second electrical connection portion 12*b* is provided with a through-hole 12*c* (see FIG. 6). Meanwhile, in the electric wire We, a terminal fitting Tm is physically and electrically connected to a terminal (see FIG. 5). The terminal fitting Tm includes an electrical connection portion Tm1 formed in a single body shape. A through-hole Tm2 is formed in the electrical connection portion Tm1. The second electrical connection portion 12*b* of the first terminal fitting 12 and the electrical connection portion Tm1 of the terminal fitting Tm are fastened and fixed together to a housing 30 described later, using the respective through-holes 12*c* and Tm2. Thus, the first terminal fitting 12 is physically and electrically connected to the first counterpart conductor.

The second terminal fitting 13 is formed in a substantially rectangular piece. The second electrical connection portion 10*b* is connected to one end of the second terminal fitting 13. Planes of the second electrical connection portion 10*b* and the second terminal fitting 13 are bonded to each other by, for example, welding. In addition, a through-hole 13*a* is formed at the other end of the second terminal fitting 13 (see FIG. 6). The second terminal fitting 13 is fastened and fixed together with the second counterpart conductor (the terminal fitting of the electric device 500) to a housing 30 described later, using the through-hole 13*a*. Thus, the second terminal fitting 13 is physically and electrically connected to the second counterpart conductor.

The magnetic core 20 is molded from a ferromagnetic material. Ferrite or the like is used as the ferromagnetic material. A magnetic core suitable for reducing the surge current flowing through the plurality of conductors 10 is used as the magnetic core 20. In the magnetic core 20, a through-hole is formed in the magnetic core 20 by forming an annular shape, and the through-hole is used as the insertion hole 20*a* into which the respective intermediate portions 10*d* of the plurality of (here, three) conductors 10 are to be inserted.

The magnetic core 20 of this example has a two-divided structure including a first core member 21 and a second core member 22 (see FIGS. 4 and 7). In the magnetic core 20, each of the first core member 21 and the second core member 22 is molded from a ferromagnetic material, and the insertion hole 20*a* is formed by integrating the first core member 21 and the second core member 22 with each other.

The first core member 21 of this example is molded in a flat plate shape or a cubic shape. On the other hand, the second core member 22 of this example is molded in a U-shape or a C-shape. In the magnetic core 20, a space portion surrounded by a plane of the first core member 21 and inner wall surfaces of the U-shape or the C-shape of the second core member 22 is formed by allowing respective free ends of the U-shape or the C-shape of the second core member 22 to abut on the plane of the first core member 21. In the magnetic core 20, the space portion is used as the insertion hole 20*a*.

In the magnetic core 20, the respective intermediate portions 10*d* of the plurality of conductors 10 are inserted into the insertion hole 20*a*, and the respective intermediate portions 10*d* are wound around the first core member 21. The respective intermediate portions 10*d* are sequentially arranged at intervals from one free end side to the other free end side, between the respective free ends of a U-shaped or C-shaped opening of the second core member 22. That is, the plurality of conductors 10 are arranged along an arrangement direction of the respective intermediate portions 10*d*.

For example, the intermediate portion 10*d* includes a first piece portion $\mathbf{10}d_1$ connected to the first electrical connection portion 10*a* in a state of being orthogonal to the first electrical connection portion 10*a* (see FIGS. 6 and 7). The first piece portion 10*d*, is arranged to face one end of the first core member 21 in a hole axis direction of the insertion hole 20*a*. In addition, the intermediate portion 10*d* includes a second piece portion $\mathbf{10}d_2$ connected to the first piece portion $\mathbf{10}d_1$ in a state of being orthogonal to the first piece portion $\mathbf{10}d_1$ and on an opposite side to the first electrical connection portion 10*a* (see FIGS. 4, 6 and 7). The second piece portion $\mathbf{10}d_2$ is arranged to face a plane of the first core member 21 facing the insertion hole 20*a*, and is housed in the insertion hole 20*a*. In addition, the intermediate portion 10*d* includes a third piece portion $\mathbf{10}d_3$ connected to the second piece portion $\mathbf{10}d_2$ in a state of being arranged to face the first piece portion $\mathbf{10}d_1$ at an interval (see FIGS. 6 and 7). The third piece portion $\mathbf{10}d_3$ is arranged to face the other end of the first core member 21 in the hole axis direction of the insertion hole 20*a*. In addition, the intermediate portion 10*d* includes a fourth piece portion $\mathbf{10}d_4$ arranged to face the second piece portion $\mathbf{10}d_2$ at an interval, intersecting the hole axis direction, and connected to the third piece portion $\mathbf{10}d_3$ (see FIGS. 4, 6, and 7). The fourth piece portion $\mathbf{10}d_4$ is arranged to face an outer plane of the first core member 21. In addition, the intermediate portion 10*d* includes a fifth piece portion $\mathbf{10}d_5$ provided adjacent to the first piece portion $\mathbf{10}d_1$ in the arrangement direction of the intermediate portion 10*d* in a state of being orthogonal to the fourth piece portion $\mathbf{10}d_4$ and connected to the fourth piece portion $\mathbf{10}d_4$ (see FIGS. 6 and 7). The fifth piece portion $\mathbf{10}d_5$ is arranged to face one end of the first core member 21 in the hole axis direction. In addition, the intermediate portion 10*d* includes a sixth piece portion $\mathbf{10}d_5$ provided adjacent to the second piece portion $\mathbf{10}d_2$ in the arrangement direction of the intermediate portion 10*d* in a state of being orthogonal to the fifth piece portion $\mathbf{10}d_5$ and connected to the fifth piece portion $\mathbf{10}d_5$ (see FIGS. 4, 6, and 7). The sixth piece portion $\mathbf{10}d_e$ is arranged to face a plane of the first core member 21 facing the insertion hole 20*a*, and is housed in the insertion hole 20*a*. The sixth piece portion $\mathbf{10}d_6$ is connected to the second electrical connection portion 10*b* through the bent portion 10*c* in a state of being orthogonal to the second electrical connection portion 10*b*.

Here, the first core member 21 is inserted into a space (a space surrounded by the first piece portion $\mathbf{10}d_1$ to the sixth piece portion $\mathbf{10}d_6$) inside each of the intermediate portions 10*d* formed in such a spiral shape (see FIG. 7). Thus, one end of the first core member 21 in the hole axis direction is arranged to face the first piece portion $\mathbf{10}d_1$ and the fifth piece portion $\mathbf{10}d_5$ of the intermediate portion 10*d*, the plane of the first core member 21 facing the insertion hole 20*a* is arranged to face the second piece portion $\mathbf{10}d_2$ and the sixth piece portion $\mathbf{10}d_6$ of the intermediate portion 10*d*, the other end of the first core member 21 in the hole axis direction is arranged to face the third piece portion $\mathbf{10}d_3$ of the intermediate portion 10*d*, and the outer plane of the first core member 21 is arranged to face the fourth piece portion $\mathbf{10}d_4$ of the intermediate portion 10*d*. In the magnetic core 20, by assembling the second core member 22 to the first core member 21 (see FIG. 7), the second piece portion $\mathbf{10}d_2$ and the sixth piece portion $\mathbf{10}d_h$ of each intermediate portion 10*d* are in a state of being inserted into the insertion hole 20*a*. For example, in the magnetic core 20, the respective free ends of the U-shape or the C-shape of the second core member 22 is bonded to the plane of the first core member 21 by an adhesive or the like. In this manner, the magnetic core 20 of this example is assembled to the respective intermediate portions 10*d* of the plurality of conductors 10. In an assembly between the plurality of conductors 10 and the magnetic core 20, a portion composed of the respective intermediate portions 10*d* and the magnetic core 20 is referred to as a core assembling portion A1 (see FIGS. 4 and 5).

Further, the connector 1 includes a housing 30 in which the plurality of conductors 10 and the magnetic core 20 are housed (see FIGS. 2 to 5). The housing 30 includes a housing member 31, a cover member 32, and a rear holder 33 (see FIGS. 2, 3, and 5). Each of the housing member 31, the cover member 32, and the rear holder 33 is molded from an insulating material such as a synthetic resin.

The housing member 31 includes a housing chamber 31*a* that houses the plurality of conductors 10 and the magnetic core 20 (see FIGS. 4, 5, 8, and 9). Further, the housing member 31 includes an abutment surface 31*b* on which the core assembling portion A1 housed in the housing chamber 31*a* abuts (see FIGS. 4, 8, and 9). Furthermore, the housing member 31 includes an opening 31*c* that is arranged to face the abutment surface 31*b* at an interval and exposes the core assembling portion A1 housed in the housing chamber 31*a* outward (see FIGS. 4 and 5). The opening 31*c* is an insertion port at the time of housing the assembly of the plurality of conductors 10 and the magnetic core 20 in the housing chamber 31*a*, and is also a working port at the time of physically and electrically connecting the first electrical connection portion 10*a* and the first counterpart conductor (the electric wire We) to each other.

Figure 8:
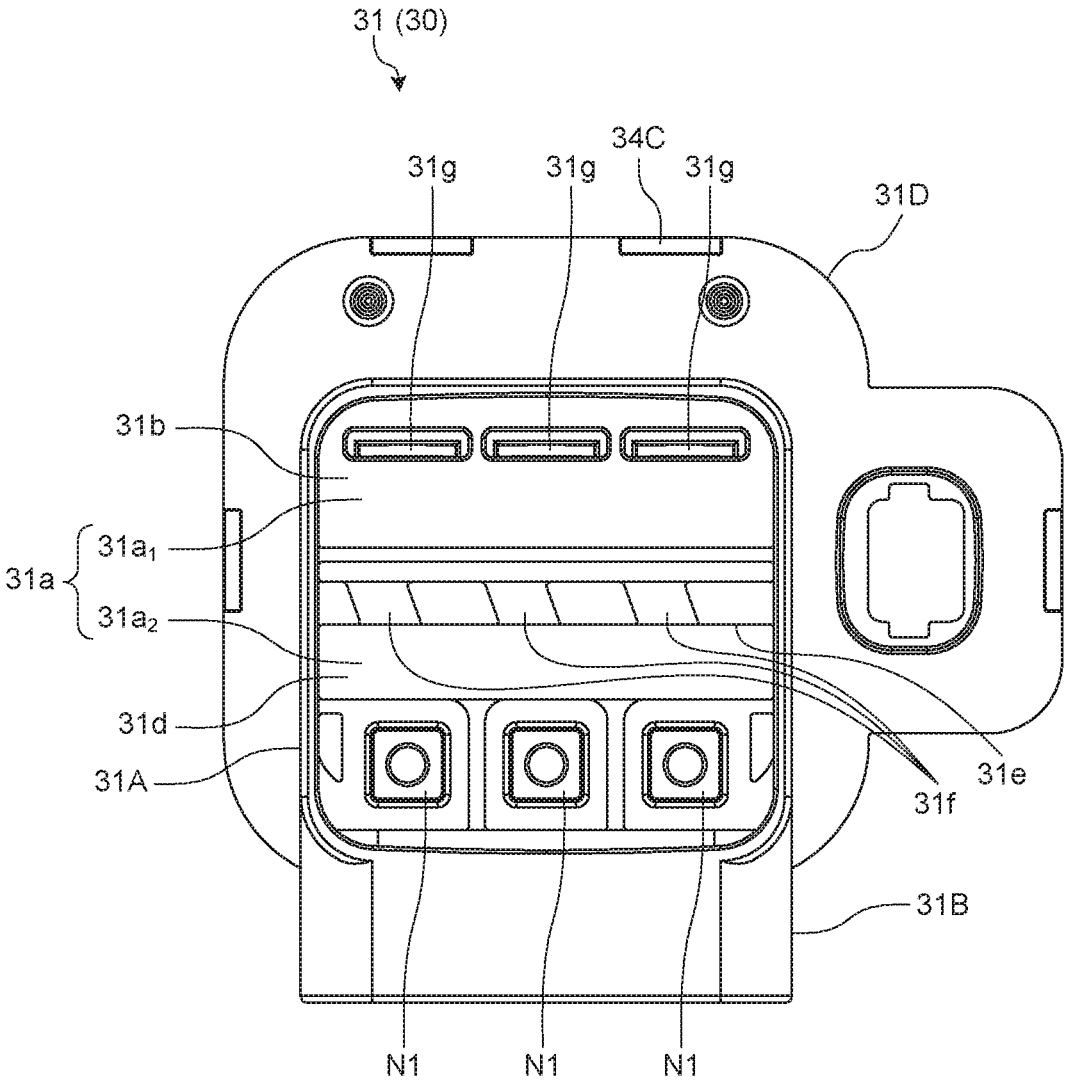
FIG. 8 is a plan view of a housing member when viewed from an opening side.
Figure 9:
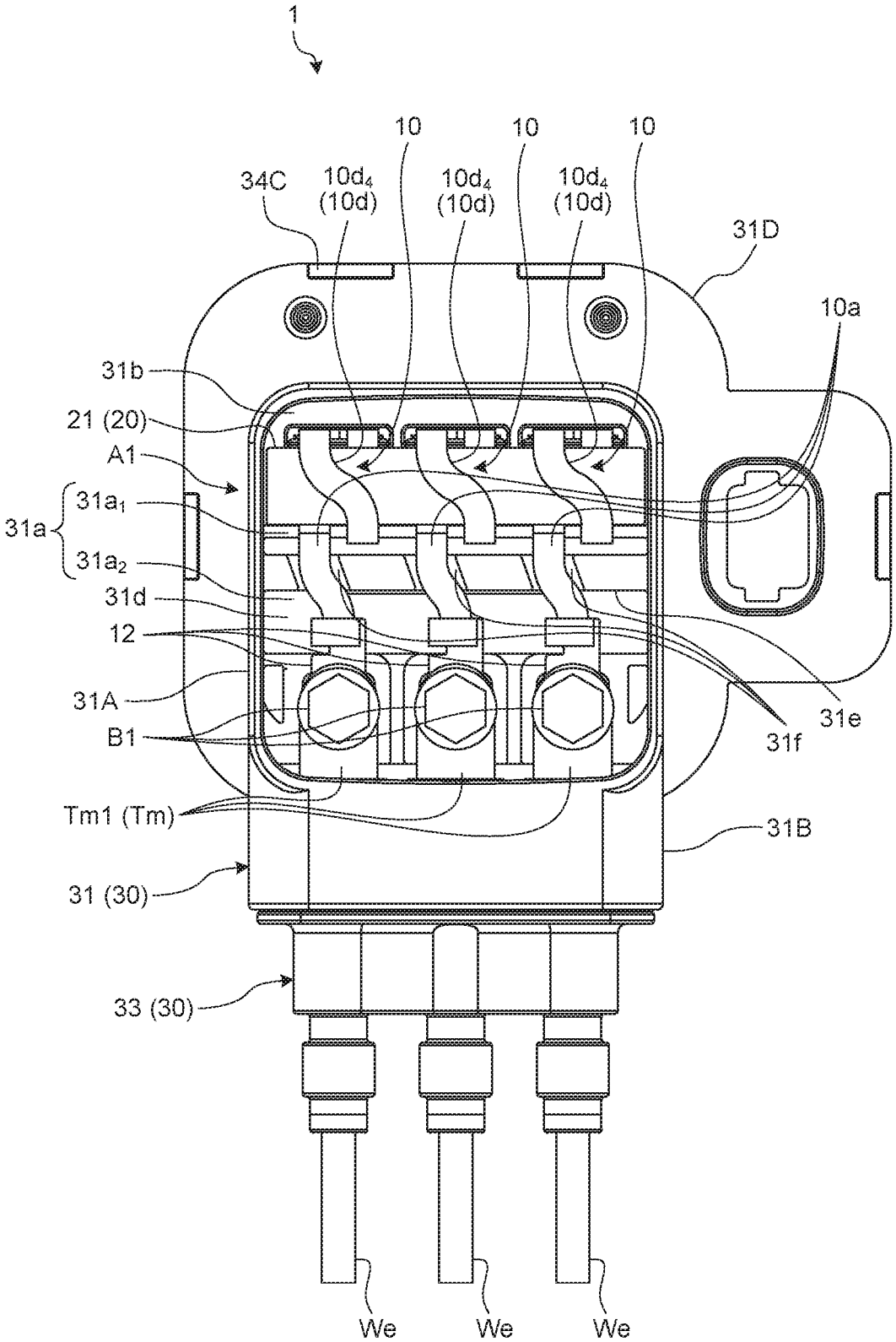
FIG. 9 is a plan view illustrating the connector (excluding the shield shell, a cover member, and a pressing member) of the embodiment.

Furthermore, the housing member 31 includes an electrical connection surface 31*d* that is arranged to face the opening 31*c* at an interval, is arranged closer to the opening 31*c* than the abutment surface 31*b* is, and electrically connects the plurality of conductors 10 to the respective first counterpart conductors (the electric wires We) (see FIGS. 4, 8, and 9). Furthermore, in the housing member 31, a partition wall 31*e* partitioning the housing chamber 31*a* into a space (hereinafter, referred to as a "first space") $\mathbf{31}a_1$ on an abutment surface 31*b* side and a space (hereinafter, referred to as a "second space") $\mathbf{31}a_2$ on an electrical connection surface 31*d* side is provided between the abutment surface 31*b* and the electrical connection surface 31*d* arranged to be offset against each other (see FIGS. 5, 8, and 9). In the housing chamber 31*a*, the abutment surface 31*b* becomes a bottom wall of the first space $\mathbf{31}a_1$, and the electrical connection surface 31*d* becomes a bottom wall of the second space $\mathbf{31}a_2$. In the housing chamber 31*a*, an interval between the bottom wall (the abutment surface 31*b*) of the first space $\mathbf{31}a_1$ and the opening 31*c* is larger than that between the bottom wall (the electrical connection surface 31*d*) of the second space $\mathbf{31}a_2$ and the opening 31*c*.

The housing member 31 includes an outer wall 31A formed in a square cylindrical shape (see FIGS. 2 to 5, 8, and 9). In the housing member 31, an inner space of the outer wall 31A is used as the housing chamber 31*a*. In the housing chamber 31*a*, the first terminal fitting 12 of the conductor 10 and the terminal fitting Tm of the terminal of the electric wire We are connected to each other in the second space $\mathbf{31}a_2$. Female screw members N1 whose screw axis direction is a cylinder axis direction of the outer wall 31A are attached to the electrical connection surface 31*d* (see FIGS. 5 and 8). The female screw member N1 is provided for each conductor 10. Each female screw member N1 is attached to the electrical connection surface 31*d* in a state of being placed on the electrical connection surface 31*d*. In addition, each female screw member N1 is arranged close to and along one of four wall surfaces of the outer wall 31A.

The second electrical connection portion 12*b* of the first terminal fitting 12 and the electrical connection portion Tm1 of the terminal fitting Tm are placed on the female screw member N1 by aligning hole axes of the respective through-holes 12*c* and Tm2 with the screw axis of the female screw member N1. The second electrical connection portion 12*b* and the electrical connection portion Tm1 are fastened and fixed together to the housing 30 in the second space $\mathbf{31}a_2$ in the housing chamber 31*a* by screwing a male screw member B1 into the female screw member N1 (see FIGS. 5 and 9).

Here, in the outer wall 31A of the housing member 31, through-holes are provided in a wall surface to which the respective female screw members N1 are provided adjacent. The housing member 31 includes an electric wire lead-out body 31B that protrudes outward from a peripheral edge portion of the through-hole and has a cylindrical shape such as a square cylindrical shape or a racetrack shape (see FIGS. 2, 3, 5, 8, and 9). The electric wire lead-out body 31B has an inner space communicating with the housing chamber 31*a* to cause the respective terminal fittings Tm fixed to the housing chamber 31*a* to be led out together with the electric wires We.

The rear holder 33 that holds the terminal fittings Tm and the electric wires We therein is attached to the electric wire lead-out body 31B. The rear holder 33 closes the inner space of the electric wire lead-out body 31B, and protrudes outward from the electric wire lead-out body 31B along a cylinder axis direction of the electric wire lead-out body 31B. The connector 1 includes a liquid-proof member 34A that is arranged between the electric wire lead-out body 31B and the rear holder 33 and fills a gap between the electric wire lead-out body 31B and the rear holder 33 to suppress permeation of a liquid into the housing chamber 31*a* (see FIG. 5). The liquid-proof member 34A is a so-called packing attached to an outer peripheral surface of the rear holder 33 and having an annular shape such as a square annular shape or a racetrack shape, and is brought into close contact with an inner peripheral surface of the electric wire lead-out body 31B and the outer peripheral surface of the rear holder 33 when the rear holder 33 is inserted into the inner space of the electric wire lead-out body 31B. Note that the connector 1 also includes a liquid-proof member (not illustrated) that is arranged between the rear holder 33 and the electric wire We and fills a gap between the rear holder 33 and the electric wire We to suppress permeation of a liquid into the housing chamber 31*a*. The liquid-proof member is a so-called packing interposed between an inner peripheral surface of the rear holder 33 and an outer peripheral surface of the electric wire We and having a circular annular shape, and is brought into close contact with the inner peripheral surface of the rear holder 33 and the outer peripheral surface of the electric wire We.

The abutment surface 31*b* is provided on a side of the electrical connection surface 31*d* opposite to the electric wire lead-out body 31B. As described above, the core assembling portion A1 abuts on the abutment surface 31*b*. Therefore, in the housing chamber 31*a*, the core assembling portion A1 is housed in the first space $\mathbf{31}a_1$.

The partition wall 31*e* is a wall body that bisects the housing chamber 31*a* in a lead-out direction of the electric wire We, and is formed in a rectangular flat plate shape or a cubic shape. The partition wall 31*e* protrudes from the bottom wall (the abutment surface 31*b*) of the first space $\mathbf{31}a_1$ toward the opening 31*c*, and further protrudes from the bottom wall (the electrical connection surface 31*d*) of the second space $\mathbf{31}a_2$ toward the opening 31*c*. An end surface of the partition wall 31*e* facing the opening 31*c* is arranged to face the opening 31*c* at an interval, and is used as a top surface overridden by the plurality of conductors 10 between the first space $\mathbf{31}a_1$ and the second space $\mathbf{31}a_2$. The partition wall 31*e* includes guide portions 31*f* that are formed in the top surface and guide the plurality of conductors 10 while being overridden by the plurality of conductors 10 between the first space 31$a_1$ and the second space 31$a_2$ (see FIGS. 5 and 8). The guide portion 31*f* of this example is formed by partially recessing the top surface for each conductor 10, and guides the first electrical connection portion 10*a* of the bus bar 11 over the first space 31$a_1$ and the second space 31$a_2$. Therefore, in the conductor 10 of the housing chamber 31*a*, the second electrical connection portion 10*b*, the bent portion 10*c*, and the intermediate portion 10*d* of the bus bar 11 and the second terminal fitting 13 are housed in the first space 31$a_1$, and the first electrical connection portion 10*a* of the bus bar 11 and the first terminal fitting 12 are housed in the second space 31$a_2$.

Here, through-holes 31*g* that guide the second terminal fittings 13 of the plurality of conductors 10 to the outside of the housing chamber 31*a* are provided in the abutment surface 31*b*, for each second terminal fitting 13 (see FIG. 8). The housing member 31 includes guide bodies 31C that guide the respective second terminal fittings 13 led out to the outside of the housing chamber 31*a* (see FIGS. 2, 4, and 5). Female screw members N2 whose screw axis direction is a hole axis direction of the through-hole 13*a* of the second terminal fitting 13 are attached to the guide bodies 31C. The female screw member N2 is provided for each second terminal fitting 13. The second terminal fitting 13 and the second counterpart conductor (the terminal fitting of the electric device 500) are placed on the female screw member N2 by aligning hole axes of the respective through-holes 13*a* with the screw axis of the female screw member N2. The second terminal fitting 13 and the second counterpart conductor are fastened and fixed together to the housing 30 outside the housing chamber 31*a* by screwing a male screw member (not illustrated) with the female screw member N2.

The cover member 32 is a member that closes the rectangular opening 31*c* of the housing member 31. The cover member 32 of this example closes the opening 31*c* by being fitted into the opening 31*c*. For example, the cover member 32 includes a closing wall portion 32*a* that is formed in a rectangular flat plate shape corresponding to a shape of the opening 31*c* of the housing member 31, and a peripheral wall portion 32*b* that is erected from a peripheral edge portion of the closing wall portion 32*a* (see FIGS. 4 and 10). The connector 1 includes a liquid-proof member 34B that is arranged between the opening 31*c* of the housing member 31 and the cover member 32 and fills a gap between the opening 31*c* of the housing member 31 and the cover member 32 to suppress permeation of a liquid into the housing chamber 31*a* (see FIGS. 2 to 5, and 10). The liquid-proof member 34B is a so-called packing attached to an outer peripheral surface of the peripheral wall portion 32*b* of the cover member 32 and having a square annular shape, and is brought into close contact with an inner peripheral surface of the opening 31*c* and the outer peripheral surface of the peripheral wall portion 32*b* of the cover member 32 when the cover member 32 is fitted into the opening 31*c*.

Figure 10:
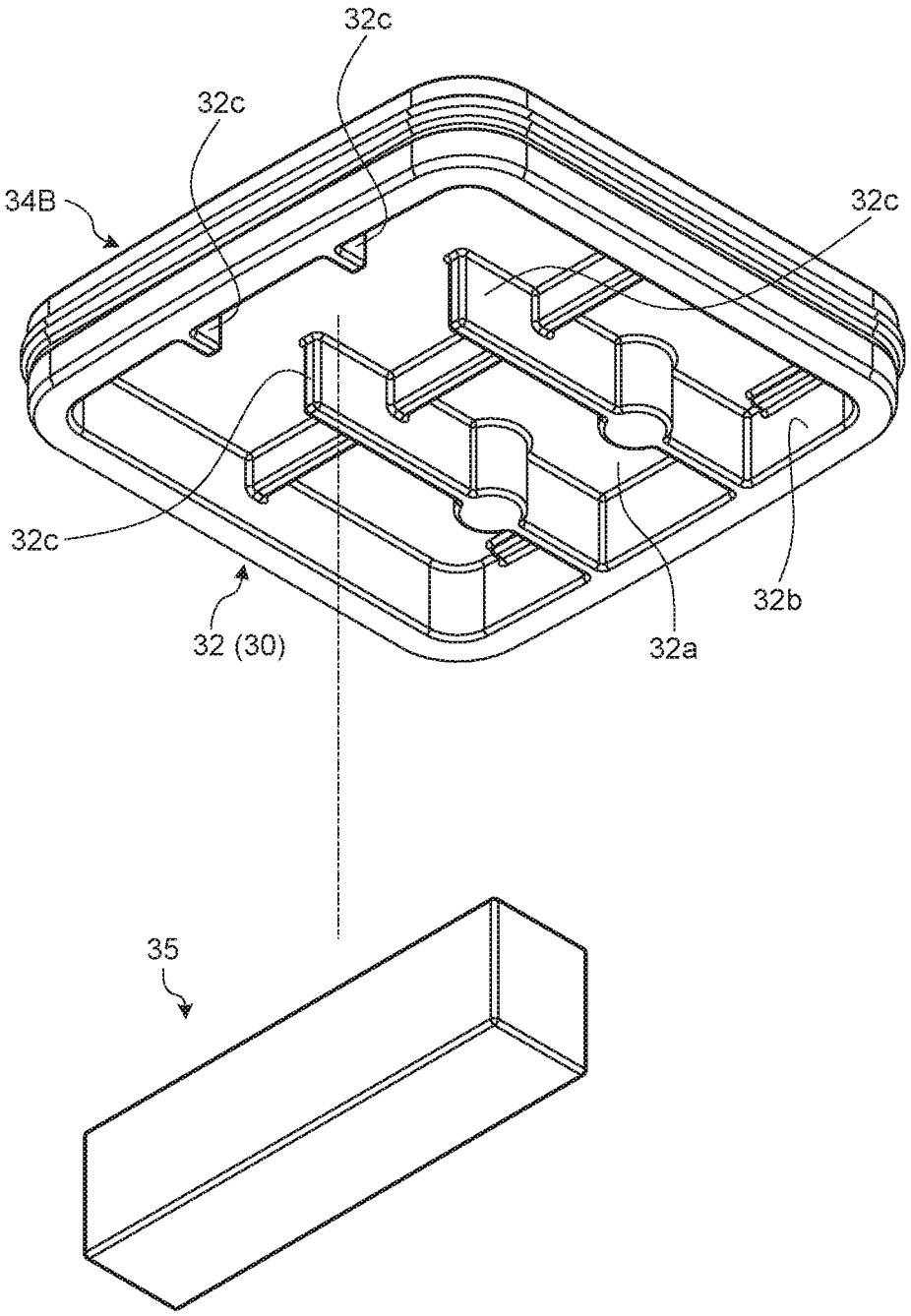
FIG. 10 is an exploded perspective view illustrating the cover member and the pressing member.
Figure 11:
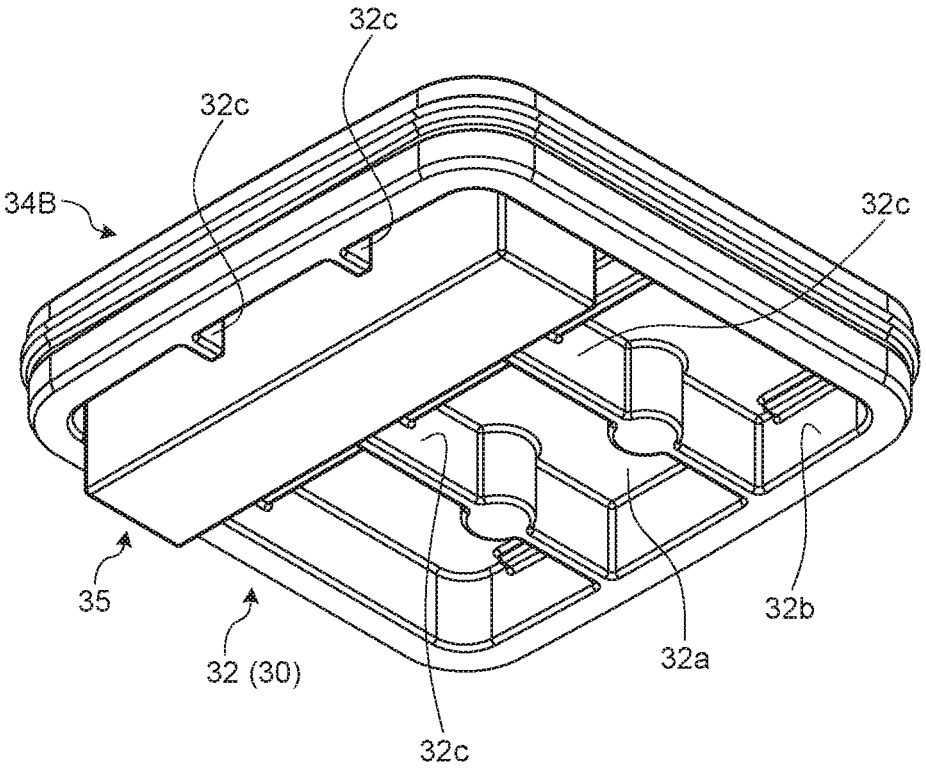
FIG. 11 is a perspective view illustrating the cover member and the pressing member.

Further, the housing 30 includes a pressing member 35 that is sandwiched between the cover member 32 and the core assembling portion A1 by pressing the core assembling portion A1 to push the core assembling portion A1 against the abutment surface 31*b* when the housing member 31 and the cover member 32 are in an assembled state (see FIGS. 4, 5, and 10). The pressing member 35 is integrated with the cover member 32 and presses the core assembling portion A1, and pushes the core assembling portion A1 against the abutment surface 31*b* accordingly (see FIG. 4). Therefore, the pressing member 35 is sandwiched between the cover member 32 and the core assembling portion A1. In other words, the core assembling portion A1 is sandwiched by the abutment surface 31*b* and the pressing member 35 in the housing chamber 31*a*. The pressing member 35 of this example is formed in a rectangular shape.

In the core assembling portion A1 of this example, in the housing chamber 31*a*, an outer plane of the second core member 22 abuts on the abutment surface 31*b*, and each of the fourth piece portions 10$d_4$ of the intermediate portions 10*d* in the respective conductors 10 is arranged to face the opening 31*c* at an interval. Therefore, the pressing member 35 presses the fourth piece portions 10$d_4$ of the respective intermediate portions 10*d* to push the outer plane of the second core member 22 against the abutment surface 31*b* when the housing member 31 and the cover member 32 are in the assembled state. For example, the pressing member 35 brings the respective fourth piece portions 10$d_4$ into contact with the outer plane of the first core member 21 by coming into contact with the fourth piece portions 10$d_4$ of the respective intermediate portions 10*d* and pressing the respective fourth piece portions 10$d_4$. As a result, the pressing member 35 causes a pressing force toward the abutment surface 31*b* to act on the outer plane of the first core member 21 through the respective fourth piece portions 10$d_4$, and thus pushes the outer plane of the second core member 22 against the abutment surface 31*b* by the pressing force. In addition, the pressing member 35 brings the respective second piece portions 10$d_1$ and sixth piece portions 10$d_6$ into contact with a plane of the second core member 22 facing the insertion hole 20*a* by coming into contact with the fourth piece portions 10$d_4$ of the respective intermediate portions 10*d* and pressing the respective fourth piece portions 10$d_4$. As a result, the pressing member 35 causes a pressing force toward the abutment surface 31*b* to act on the plane of the second core member 22 facing the insertion hole 20*a* through the respective second piece portions 10$d_2$ and sixth piece portions 10$d_6$, and thus pushes the outer plane of the second core member 22 against the abutment surface 31*b* by the pressing force.

Here, the pressing member 35 is integrated with the cover member 32. The pressing member 35 of this example is molded of an insulating material such as a synthetic resin, as a component different from the cover member 32. In this case, the pressing member 35 may be fitted into and integrated with the cover member 32 or may be integrated with the cover member 32 by welding, screwing, or the like. Here, the cover member 32 is provided with a plurality of ribs 32*c*, and the pressing member 35 is fitted between the respective ribs 32*c* (see FIGS. 10 and 11). In addition, the pressing member 35 may be integrated with the cover member 32 by being formed integrally with the cover member 32 as a part of the cover member 32.

The connector 1 is attached to a housing 501 of the electric device 500 (see FIG. 1). In the connector 1, the second terminal fittings 13 of the conductors 10 are inserted into the housing 501 together with the guide bodies 31C of the housing 30. The housing member 31 of the housing 30 includes a flange 31D that is formed between the outer wall 31A and the guide bodies 31C along an outer peripheral surface of the outer wall 31A (see FIGS. 2 to 5, 8, and 9). The connector 1 includes a liquid-proof member 34C that is arranged between the flange 31D and an outer wall surface of the housing 501 and fills a gap between the flange 31D and the outer wall surface of the housing 501 to suppress permeation of a liquid into the housing 501 (see FIGS. 2 to 5, 8, and 9). The liquid-proof member 34C is a so-called packing attached to a facing wall surface of the flange 31D facing the housing 501, and is formed in an annular shape along an outer peripheral edge of the flange 31D. The liquid-proof member 34C is brought into close contact with the facing wall surface of the flange 31D and the outer wall surface of the housing 501 when the connector 1 is attached to the housing 501.

In the connector 1, the housing 30 is covered with a shield shell 40 (see FIG. 1) in order to suppress intrusion of noise from the outside. The shield shell 40 is molded from a conductive material such as a metal.

The shield shell 40 of this example has a divided structure by a first shield member 41, a second shield member 42, a third shield member 43, and a fourth shield member 44. A main portion of the first shield member 41 is formed as a box-shaped portion that covers the outer wall 31A of the housing member 31 and the cover member 32 from a side facing the cover member 32. A main portion of the second shield member 42 is formed as a cylindrical portion that covers the electric wire lead-out bodies 31B of the housing member 31 from an outer peripheral surface side. A main portion of the third shield member 43 is formed as a flat plate-shaped portion that covers a side facing the first space 31$a_1$ in the flange 31D of the housing member 31. A main portion of the fourth shield member 44 is formed as a flat plate-shaped portion that covers a side facing the second space 31$a_2$ in the flange 31D.

In the connector 1, the first shield member 41 is screwed and fixed to the cover member 32 using female screw portions 32*d* (see FIGS. 2, 3, and 5) provided in the cover member 32 and male screw members B3 (see FIG. 1). In addition, in the connector 1, the third shield member 43 and the fourth shield member 44 are screwed and fixed using female screw portions (not illustrated) provided in the third shield member 43 and male screw members B4 (see FIG. 1). In addition, in the connector 1, the third shield member 43 is screwed and fixed to the housing 501 of the electric device 500 using female screw portions (not illustrated) provided in the housing 501 of the electric device 500 and male screw members B5 (see FIG. 1). In addition, in the connector 1, the first shield member 41, the second shield member 42, and the fourth shield member 44 are fastened and fixed together to the housing 501 using the female screw portions (not illustrated) provided in the housing 501 and the male screw members B5 (see FIG. 1).

Further, in the connector 1, an outer peripheral surface of the second shield member 42 and the electric wires We led out from the electric wire lead-out bodies 31B are covered with a braid 51 in order to suppress intrusion of noise from the outside (see FIG. 1). The braid 51 is a member woven in a cylindrical and mesh shape with a conductive material such as a metal. The braid 51 comes into pressure contact with the outer peripheral surface of the second shield member 42 using a cylindrical connection member 52, and an electrical connection state of the braid 51 with the second shield member 42 is maintained accordingly.

As described above, in the connector 1 of the present embodiment, the core assembling portion A1 composed of the respective intermediate portions 10*d* of the plurality of conductors 10 and the magnetic core 20 is sandwiched by the abutment surface 31*b* and the pressing member 35 in the housing chamber 31*a*. Here, the ferrite constituting the magnetic core 20 is a ceramic having magnetism, and is vulnerable to impact due to high brittleness. However, in the connector 1 of the present embodiment, rattling between the core assembling portion A1 and the housing 30 is suppressed by the pressing member 35. Therefore, even when an external input acts, the magnetic core 20 can be protected from the external input. Further, in the connector 1, generation of a sound when the external input acts can be suppressed according to a rattling suppressing effect.

In addition, generally, the magnetic core is fixed to the housing using a potting agent injected into the housing chamber. However, in the connector 1 of the present embodiment, the rattling between the core assembling portion A1 and the housing 30 is suppressed by the pressing member 35, and it becomes thus unnecessary to inject the potting agent into the housing chamber 31*a*. Therefore, in the connector 1, components such as the conductor 10 or the magnetic core 20 are not solidified by the potting agent, and a disassembling operation between the respective components can thus be easily performed, such that the connector 1 is excellent in terms of maintenance.

Meanwhile, the potting agent improves a liquid-proof property of conductive components such as the conductor or the magnetic core against by covering the conductive components. In the connector 1 of the present embodiment, the permeation of the liquid into the housing chamber 31*a* can be suppressed by various liquid-proof members (the liquid-proof members 34A to 34C and the like). Therefore, it is possible to improve the liquid-proof property of conductive components such as the conductor 10 or the magnetic core 20 without using the potting agent.

In addition, in the connector 1 of the present embodiment, the conductor 10 is bent in an L-shape at the bent portion 10*c* that is closer to the second electrical connection portion 10*b* than the core assembling portion A1 is. Therefore, for example, the second terminal fitting 13 connected to the second electrical connection portion 10*b* can be housed inside the housing 501 of the electric device 500. Therefore, it is possible to reduce a size of the connector 1 in a state where the connector 1 is attached to the electric device 500 of the counterpart.

In the connector according to the present embodiment, the core assembling portion composed of the respective intermediate portions of the plurality of conductors and the magnetic core is sandwiched by the abutment surface and the pressing member in the housing chamber, and rattling between the core assembling portion and the housing is thus suppressed. Therefore, in the connector, even when an external input acts, the magnetic core can be protected from the external input.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a plurality of conductors that are electrically connected to counterparts;

an annular shaped magnetic core that includes an insertion hole into which respective intermediate portions of the plurality of conductors are inserted; and a housing that houses the plurality of conductors and the magnetic core, wherein the housing includes: a housing member that is provided with a housing chamber that houses the plurality of conductors and the magnetic core, an abutment surface on which a core assembling portion abuts, and an opening that is arranged to face the abutment surface at an interval and exposes the core assembling portion housed in the housing chamber outward, the core assembling portion being composed of the respective intermediate portions of the plurality of conductors and the magnetic core housed in the housing chamber;

a cover member that closes the opening; and a pressing member that is sandwiched between the cover member and the core assembling portion by pressing the core assembling portion to push the core assembling portion against the abutment surface when the housing member and the cover member are in an assembled state.

2. The connector according to claim 1, wherein the pressing member is integrated with the cover member.

3. The connector according to claim 1, wherein the conductor includes: a first electrical connection portion that is electrically connected to a first counterpart conductor prepared for each conductor;

a second electrical connection portion that is electrically connected to a second counterpart conductor prepared for each conductor;

a bent portion that is bent between a side of the first electrical connection portion and a side of the second electrical connection portion; and an intermediate portion that is provided between the first electrical connection portion and the bent portion.

4. The connector according to claim 2, wherein the conductor includes: a first electrical connection portion that is electrically connected to a first counterpart conductor prepared for each conductor;

a second electrical connection portion that is electrically connected to a second counterpart conductor prepared for each conductor;

a bent portion that is bent between a side of the first electrical connection portion and a side of the second electrical connection portion; and an intermediate portion that is provided between the first electrical connection portion and the bent portion.

5. The connector according to claim 3, wherein the conductor includes: a bus bar that includes the first electrical connection portion, the second electrical connection portion, the bent portion, and the intermediate portion;

a first terminal fitting that is physically and electrically connected to the first electrical connection portion and is physically and electrically connected to the first counterpart conductor; and a second terminal fitting that is physically and electrically connected to the second electrical connection portion and is physically and electrically connected to the second counterpart conductor.

6. The connector according to claim 1, further comprising:

a liquid-proof member that is arranged between the opening of the housing member and the cover member and fills a gap between the opening of the housing member and the cover member to suppress permeation of a liquid into the housing chamber.

7. The connector according to claim 2, further comprising:

a liquid-proof member that is arranged between the opening of the housing member and the cover member and fills a gap between the opening of the housing member and the cover member to suppress permeation of a liquid into the housing chamber.

8. The connector according to claim 3, further comprising:

a liquid-proof member that is arranged between the opening of the housing member and the cover member and fills a gap between the opening of the housing member and the cover member to suppress permeation of a liquid into the housing chamber.

9. The connector according to claim 5, further comprising:

a liquid-proof member that is arranged between the opening of the housing member and the cover member and fills a gap between the opening of the housing member and the cover member to suppress permeation of a liquid into the housing chamber.

* * * * *